US006254500B1

(12) United States Patent
Yoneyama

(10) Patent No.: US 6,254,500 B1
(45) Date of Patent: Jul. 3, 2001

(54) RACKET WITH MESHED TITANIUM REINFORCEMENT

(75) Inventor: Minoru Yoneyama, Niigata (JP)

(73) Assignee: Yonex Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/333,514

(22) Filed: Jun. 15, 1999

(51) Int. Cl.[7] ..... A63B 49/02; A63B 49/14
(52) U.S. Cl. ..... 473/544; 473/537
(58) Field of Search ..... 473/521, 524, 473/535, 536, 537, 544, 547

(56) References Cited

U.S. PATENT DOCUMENTS

| | | | | |
|---|---|---|---|---|
| 3,755,037 | * | 8/1973 | Erwin et al. | 473/535 X |
| 4,283,050 | * | 8/1981 | Nagamoto | 473/535 |
| 5,935,028 | * | 8/1999 | Lo | 473/544 |

FOREIGN PATENT DOCUMENTS

| | | | | |
|---|---|---|---|---|
| 1436755 | * | 5/1976 | (GB) | 473/FOR 180 |
| 54-41364 | | 3/1979 | (JP) . | |
| 61-127766 | | 8/1986 | (JP) . | |
| 4-5793 | * | 1/1992 | (JP) | 473/FOR 180 |
| 9-215780 | | 8/1997 | (JP) . | |
| 11-290484 | * | 10/1999 | (JP) . | |

* cited by examiner

*Primary Examiner*—Raleigh W. Chiu
(74) *Attorney, Agent, or Firm*—Wenderoth, Lind & Ponack, L.L.P.

(57) ABSTRACT

A racket which is capable of mitigating the shock transmitted to the handle, improving the stability of the face of the head-frame, and enhancing the ability to damp the vibration imparted to the frame upon impact is disclosed. The racket has two meshed pieces (5) integrally attached to the surface of each of the lateral sides of a head-frame (1) so that the meshed pieces (5) are opposed to each other across the sweet spot of the racket. The meshed piece (5) is made from titanium and has a predetermined shape.

7 Claims, 4 Drawing Sheets

RACKET WITH MESHED TITANIUM REINFORCEMENT

BACKGROUND OF THE INVENTION

1. Field of the Invention

This invention relates to rackets for tennis, badminton or other similar games, particularly to rackets having weights provided on a portion of the frame thereof.

2. Description of the Related Art

Rackets provided with weights are publicly disclosed in Japanese unexamined Utility Model Publication No. 54-41364. This type of racket has a frame made from foam synthetic resin, and has weights made from aluminum, titanium or other similar material. These weights are fixed onto the lateral sides of a head-frame so as to oppose each other across the sweet spot of the racket. The frame and the weights are both covered with fiber-reinforced material. With this structure, the mass of the frame can be concentrated at the sweet spot, which results in mitigation of shock transmitted to the handle upon striking a ball, and offers a pleasant feeling upon striking of a ball.

Generally, the weight of such a part is limited to be less than a few grams. Thus, if metal having a large weight per unit area is to be used as the weight, as is the case with conventional rackets, the position to which the weight is fixed had to be limited to a small area. Therefore, even though the shock being transmitted to the handle can be mitigated, these weights could not contribute much to stabilizing the face of the head-frame and reducing the amount of bending deformation.

Further, in conventional cases, the weights had to be covered with cylindrically-knitted fiber reinforced material upon fixing, in order to realize firm attachment. This covering procedure was extremely laborious. It is also possible to flatten the conventional metal weights into thin strips and fix them to the frame. In this case, however, the repetitive bending of the frame caused by the shock imparted upon each ball-strike impairs the bond between the metal weight and the frame, owing to the large difference in ratio of extension of the metal and the fiber reinforced resin-made frame. Thus, it is not possible to integrally maintain the weight and the frame as one body.

SUMMARY OF THE INVENTION

In order to solve the above-mentioned and other problems, it is an object of this invention to provide a racket which is capable of mitigating the shock transmitted to the handle, improving the stability of the face of the head-frame, and enhancing the ability to damp the vibration imparted to the head-frame upon striking, by fixing weights onto the lateral sides of the frame in a manner so as to extend over a rather wide area thereof.

Another object of this invention is to provide a racket in which the weights can be easily attached to the surface of the fiber reinforced resin-made frame, and in which the bond between the weights and the frame is not impaired by the repetitive bending of the frame.

A racket according to one aspect of the present invention has meshed pieces integrally attached to the surface of lateral sides of a racket frame so that the meshed pieces are opposed to each other across the sweet spot of the racket. The meshed piece is made from titanium and has a predetermined shape.

Although the specific gravity of titanium is 4.53, which is considerably larger than that of aluminum, which is 2.7, since the titanium weights are formed to have a mesh structure, they can be attached along a rather wide area of the lateral sides of the frame (in the longitudinal direction,) in a manner so that the sweet spot of the racket is interposed therebetween. In other words, the area per unit weight to which the meshed piece is attached can be enlarged. Thus, not only is it possible to provide the conventional shock-mitigating characteristics, the toughness of titanium also makes it possible to reduce the amount of bending of the head-frame, improve the stability of the face of the frame, and enhance the ability in damping the vibration imparted to the head-frame upon impact.

In addition to the fact that titanium has an extremely large extension ratio (23%) compared to other titanium alloys, the mesh structure further enhances the extension characteristic of this titanium-made member. Therefore, the meshed piece can be bent and deformed with the frame even if it is attached along a rather wide area of the frame in the longitudinal direction. Further, upon bonding the meshed piece to the frame with the resin used for molding, the resin can penetrate through the multitude of small openings of the meshed piece. Therefore, the weight can be easily and securely attached to the frame.

Preferably, the meshed piece is wrapped around the whole periphery of the frame. With this structure, the toughness of the whole section of the head-frame can be increased, and the vibration-damping characteristic can be further improved.

The racket frame is preferably of the type used for tennis, and each of the meshed pieces attached thereto weighs from 0.7 to 2.0 grams.

Further, the racket frame is preferably of the type used for badminton, and each of the meshed pieces attached thereto weighs from 0.2 to 0.5 grams.

As many different embodiments of this invention may be made without departing from the spirit and scope thereof, it is to be understood that the invention is not limited to the specific embodiments described hereinafter.

BRIEF DESCRIPTION OF THE DRAWINGS

FIGS. 1A–1B shows a tennis racket according to an embodiment of the present invention, wherein FIG. 1A is a front view thereof, and FIG. 1B is a side view thereof;

FIGS. 3A–3C show vibration-damping characteristics upon impartment of vibration to the frame when shock is applied to the gut-strung face of the racket, wherein FIG. 3A shows the characteristics of a racket with no weights, FIG. 3B shows the characteristics of a racket having a pair of lead plummets (1 gram each) attached to the lateral sides of its frame, and FIG. 3C shows the characteristics of a racket according to an embodiment of the present invention.

DETAILED DESCRIPTION OF PREFERRED EMBODIMENTS

A preferred embodiment of the present invention will be described hereinafter with reference to the accompanying drawings.

Figure 1A:
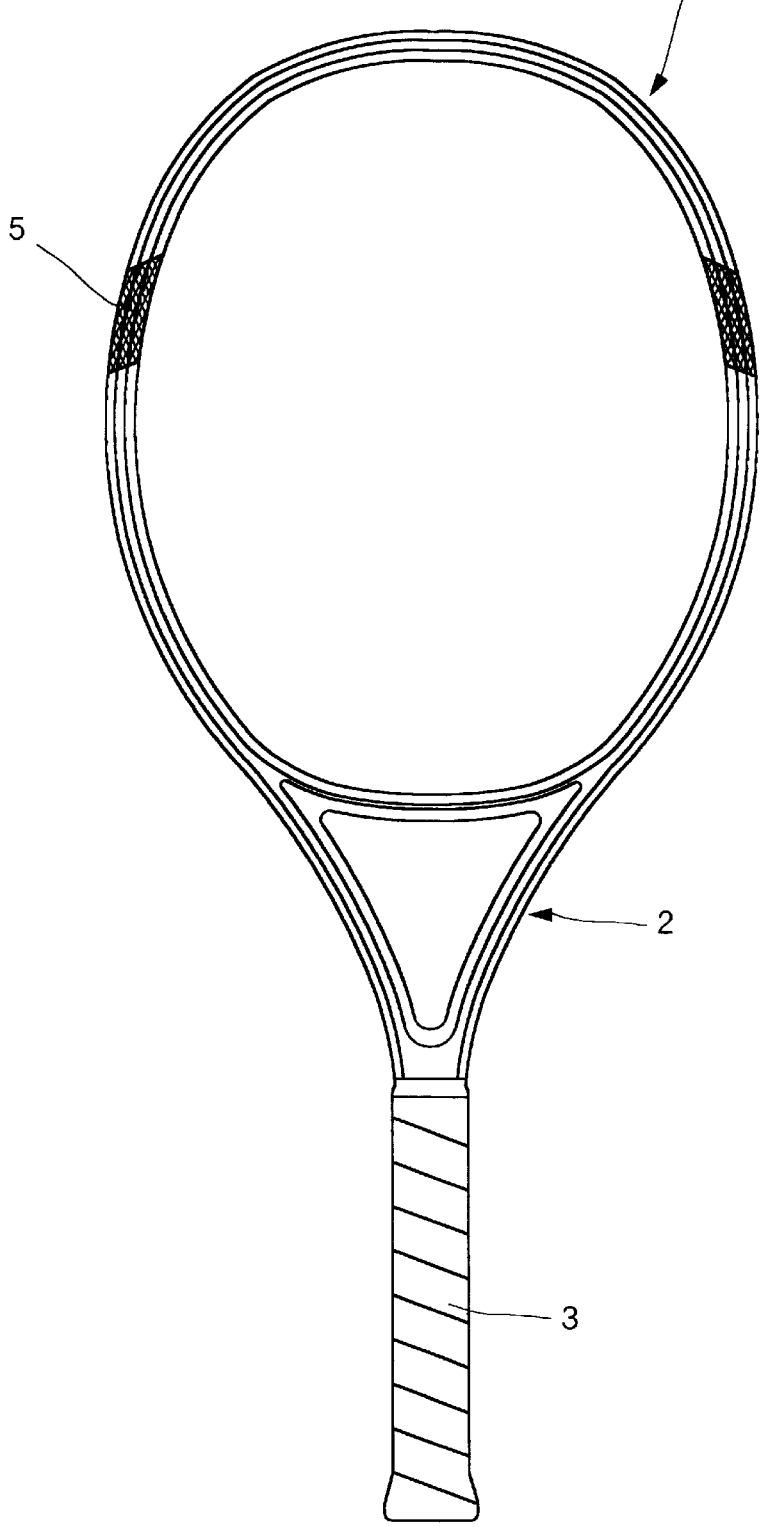
Figure 1B:
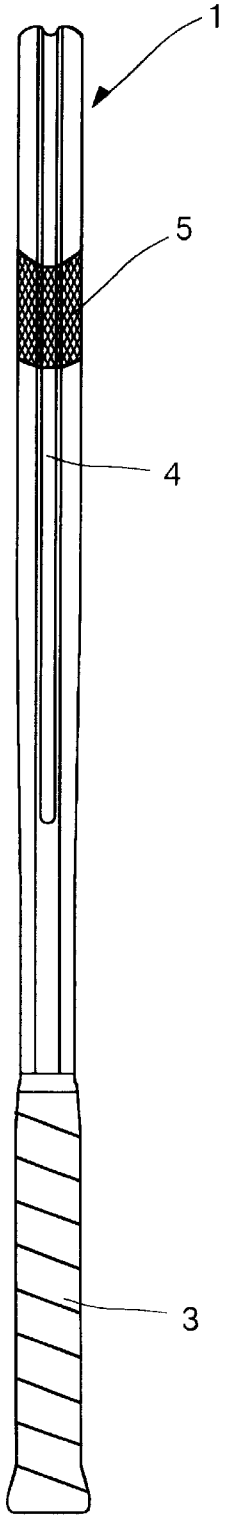

FIG. 1A is a front view of a racket frame according to one aspect of the present invention, and FIG. 1B is a side view thereof.

The racket frame shown in FIGS. 1A and 1B comprises a head-frame 1 having an oval-like front view, a connecting shaft 2 which is branched to form a triangular shape, and a handle 3.

The head-frame 1 and the shaft 2 are integrally formed from fiber reinforced resin into a hollow structure. The handle 3 is integrally attached to the rectilinearly-extending bottom end of the shaft 2. The head-frame 1 is formed to have an oval-like longitudinal section, and there is a recess 4 provided around the outer periphery thereof. This recess 4 is capable of receiving a strip band which covers eyelets for inserting gut strings. In FIGS. 1A and 1B, the gut strings are not shown for simplicity of the drawings.

Figure 2:
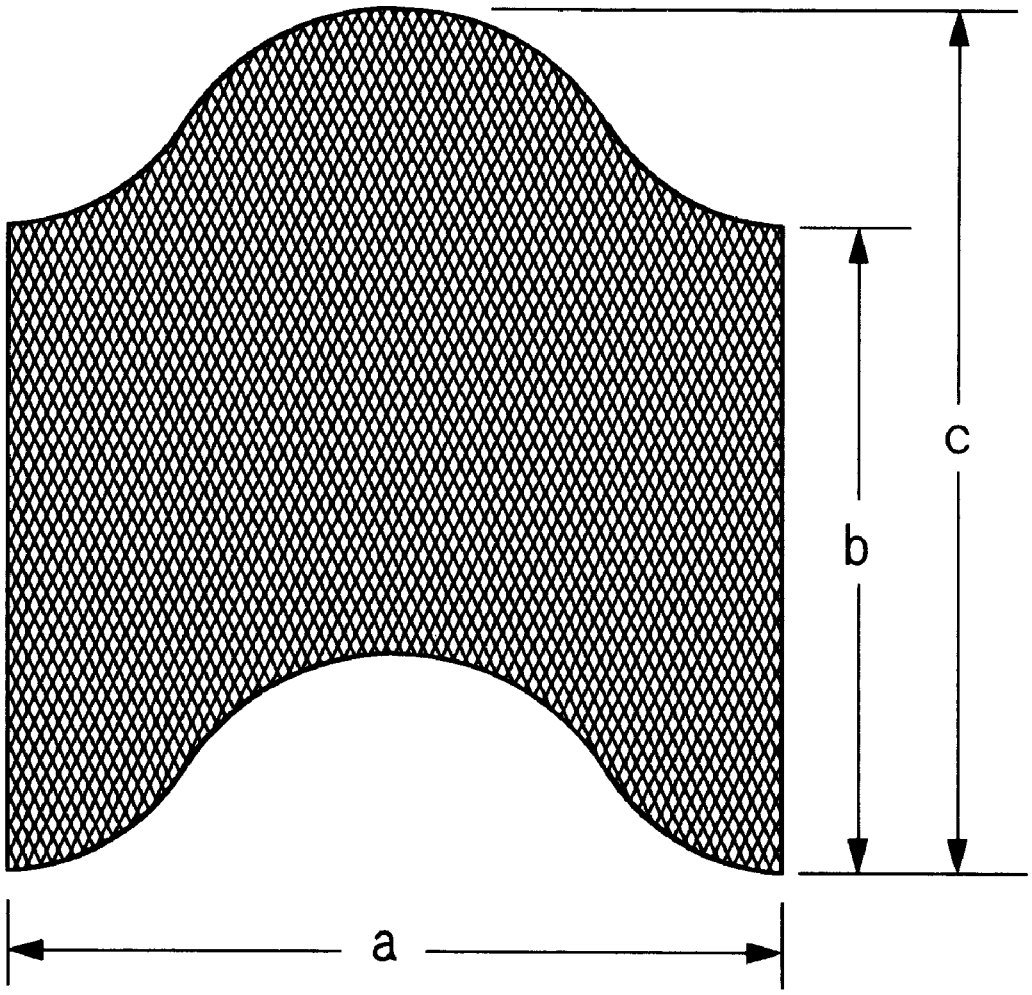
FIG. 2 is an enlarged plan view of a meshed piece according to an embodiment of the present invention.

In this embodiment, a pair of titanium-made meshed pieces 5 are integrally wrapped on the lateral sides of the head-frame 1 so that the sweet spot located in the central portion of the racket face is interposed therebetween. The dimension of the meshed piece 5 is as shown in FIG. 2, i.e., the width a is 70 mm, length b is 60 mm, and length c is 82 mm. As can be seen from the same Figure, the upper end of the mesh piece 5 is projectingly curved outwards while the lower end thereof is curved inwards in the same shape. The meshed piece 5 weighs 1 g (gram), and is made from titanium standardized by Japanese Industrial Standard (JIS) Class 2, having a specific gravity of 4.53, hardness of 200 (Hv), tensile strength of 69.6 kgf/mm$^2$, and extension ratio of 23%. The openings of the meshed piece 5 have a diamond-like shape, and each side thereof is about 0.8 mm. The multitude of openings can be formed by piercing or by etching into a thin titanium sheet, or by subjecting the thus pierced titanium sheet to rolling.

The meshed piece 5 is integrally fixed to the head-frame 1 according to the following procedure. Before molding the fiber reinforced resin-made frame, the meshed piece 5 is wrapped around the head-frame 1 so that the sweet spot, which is located in the central portion of the head-frame, is interposed therebetween. Here, the protruding upper end of the meshed piece 5 faces upwards, and the center of the protrusion is placed at the inner side of the head-frame 1. The head-frame 1 is then hot molded in a metal die, and the meshed pieces 5 are integrated therewith. Finally, the surface of the frame 1 is covered with a coating.

A test was carried out in order to compare the bending characteristics of a racket frame according to one embodiment of this invention having meshed pieces attached to the head-frame, and the same racket frame without any meshed pieces, the results of which are listed in TABLE 1 below.

The column labeled "Bending upon holding both ends" in TABLE 1 shows the amount of bending at the central portion of the racket when a bending test is carried out by holding both the upper and lower ends of the racket and applying a load to the central portion thereof, i.e., to the bottom end of the head-frame. The "Bending upon holding one end" column lists the amount of bending at the to tip of the head-frame when a bending test is carried out by holding the handle of the racket and applying a load to the tip portion of the head-frame. The column labeled "longitudinal" beneath "Frame deformation" shows the amount of lateral deformation when the top and bottom portions of the head-frame are longitudinally compressed. The "lateral" column lists the amount of longitudinal deformation when the right and left sides of the head-frame are laterally compressed.

From TABLE 1, it can be readily appreciated that according to the racket of the present invention in which a pair of meshed pieces are fixed to the lateral sides of a head-frame, both the amount of bending and the amount of lateral/longitudinal deformation are remarkably reduced in comparison with the racket without weights. This result signifies that the stiffness of the head-frame has increased. Particularly, it can be appreciated that the stability of the face of the head-frame has remarkably improved, from the fact that the longitudinal stiffness increased by about 13%, and the lateral stiffness increased by about 2%.

Next, a vibration-damping test was conducted by using a tennis racket having a weight of 236 g, the center of gravity located 376 mm away from the end of the handle, and a face pressure of 57 lb after stringing the gut strings. The handle of the racket was held so that the racket face was kept horizontal. A steel ball having a weight of 68 g was dropped from a height of 1 m onto the gut-strung face, and the vibration-damping effect (i.e., degree of damping of vibration being applied to the handle) was measured by an accelerometer pickup (CF-350 PORTABLE DUAL CHANNEL FFT ANALYZER) placed on the handle at a position 12 cm away from the handle end.

Figure 3A:
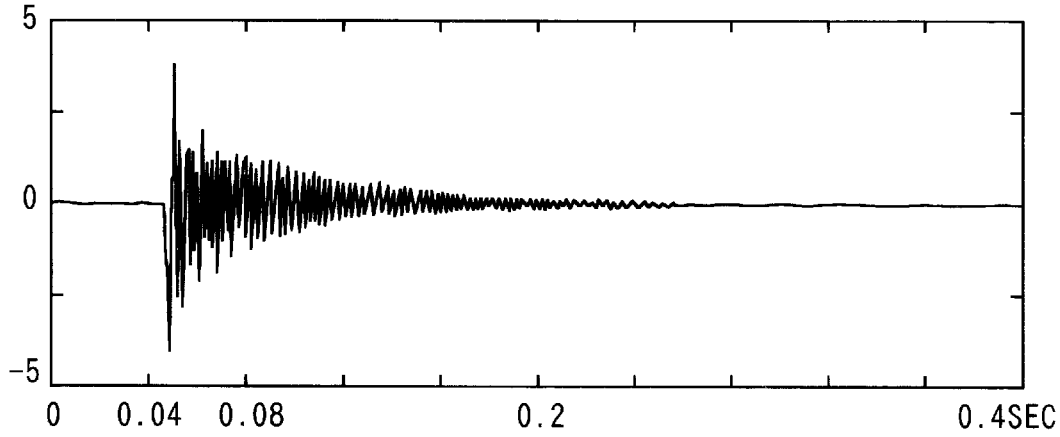
Figure 3B:
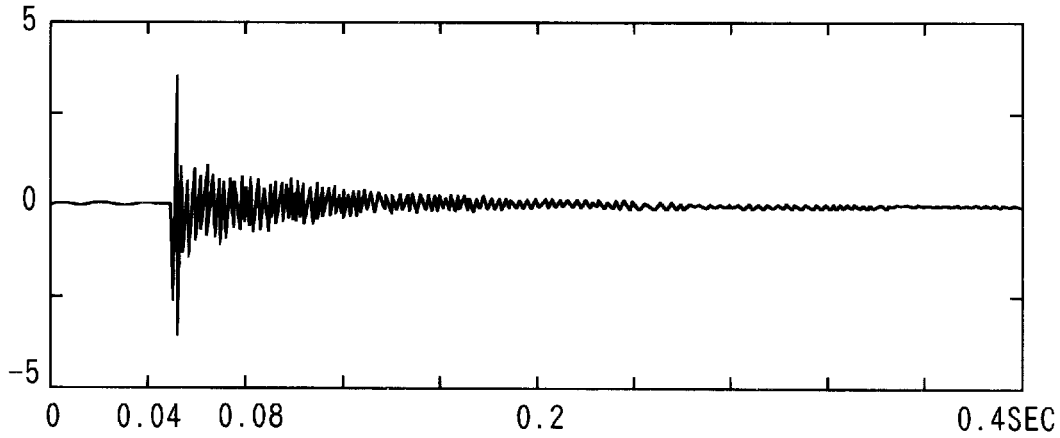
Figure 3C:
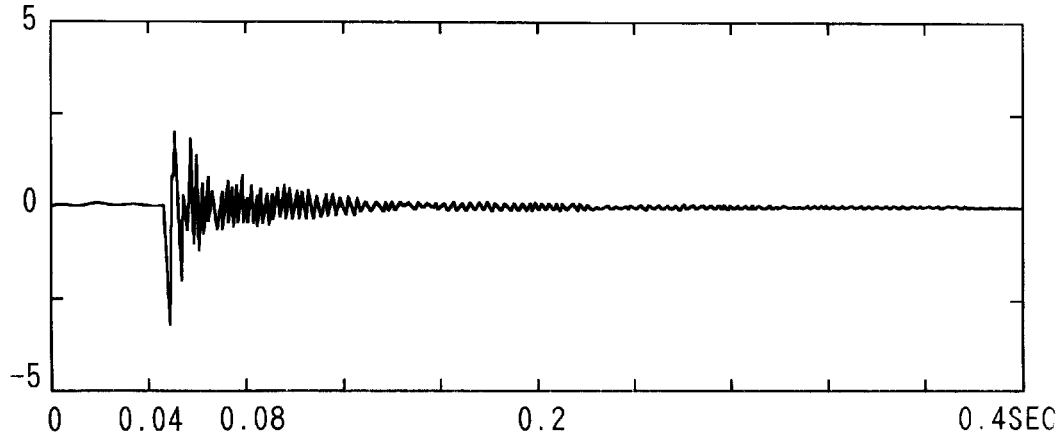

FIG. 3A is a diagram showing a vibration-damping characteristic of a racket having no weights attached to its head-frame; FIG. 3B is a diagram showing a vibration-damping characteristic of a racket having a pair of lead plummets (1 g each) mounted on the lateral sides of its head-frame; and FIG. 3C is a diagram showing a vibration-damping characteristic of a racket according to one aspect of the present invention having a pair of meshed pieces (1 g each) attached to the lateral sides of its head-frame, as shown in FIG. 1. The rackets used in FIGS. 3B and 3C weigh 238 g and the center of gravity thereof is located 378 mm away from the end of the handle, since a pair of lead plummets and a pair of meshed pieces are attached to the head-frames of the respective rackets.

TABLE 1

| | | Bending upon holding both ends | | | Bending upon holding one end | Frame deformation | |
|---|---|---|---|---|---|---|---|
| | | | | | | 80 kgf | 40 kgf |
| Specification | Weight g | 60 kgf mm | 80 kgf mm | 100 kgf mm | 15 kgf mm | longitudinal mm | lateral mm |
| No meshed pieces | 236 | 14.9 | 20.1 | 25.0 | 33.6 | 9.6 | 7.2 |
| Present invention | 238 | 13.7 | 18.3 | 22.9 | 32.4 | 8.5 | 7.0 |

From FIGS. 3A and 3B, it is apparent that a better damping effect can be obtained from the racket provided with lead weights than from the racket without weights. Further, from comparing FIGS. 3B and 3C, it can be appreciated that the racket of the present invention provided with the meshed pieces has a superior damping effect against vibration caused by initial shock impartment, not to mention the subsequent, excellent damping effect.

Although the above description is of a preferred embodiment of the present invention applied to a tennis racket, this invention is also applicable to badminton rackets or rackets used in other sports.

Figure 4:
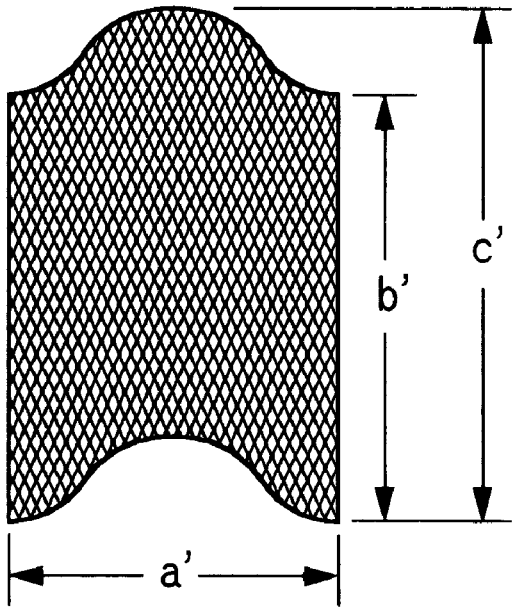
FIG. 4 is an enlarged plan view of a meshed piece preferably applied to a badminton racket.

In applying the present invention to a badminton racket, the dimensions of titanium meshed pieces 5*a* are much smaller than the ones used for a tennis racket, as is shown in FIG. 4, since the badminton rackets are lighter in weight. Here, the width a' is 30 mm, length b' is 42 mm, and length c' is 50 mm. Other features are to be the same as those of the meshed pieces for tennis rackets.

Various modifications can be made without departing from the scope of the present invention. For example, instead of winding the meshed pieces around the whole periphery of the head-frame as in the above embodiment, it is possible to form the meshed pieces into strips and attach a pair of these strips on the inner surface of each of the lateral sides of the head-frame, (i.e., four strips in total,) so that each pair of strips sandwiches the gut-strung face from both the upper and lower sides. In other embodiments, a pair of strips can be attached to the outer surface of each lateral sides of the head-frame (a total of four strips), or, to both the inner and outer surfaces of the lateral sides of the head-frame (a total of eight strips).

In the above-described embodiment, the length of one side of each opening of the meshed pieces is 0.8 mm; but in other embodiments, this length can be in the range of 2.0 mm or less. However, the length of the opening should not exceed 2.0 mm, because the surface area of the meshed piece having the same weight as that of the above embodiment will become too large, and cause difficulty in maintaining the predetermined shape of the meshed piece upon wrapping and attachment.

Although the weight of each meshed piece is described to be 1 g in the above embodiment, it is preferable to vary the weight thereof according to the weight of the racket. The weight of the meshed piece can be in the range of 0.7 to 2.0 g for commonly used, fiber reinforced resin-made tennis rackets. The weight of the meshed piece can be in the range of 0.2 to 0.5 g for badminton rackets, since these rackets are much lighter than tennis rackets.

What is claimed is:

1. A tennis racket having meshed pieces integrally attached to respective surfaces of lateral sides of a frame thereof so that said meshed pieces oppose each other across a sweet spot of said tennis racket, wherein each of said meshed pieces is made from titanium, has a predetermined width, and is wound around the whole periphery of each of said lateral sides of said frame, and wherein each of said meshed pieces has a weight ranging from 0.7 to 2.0 grams.

2. A badminton racket having meshed pieces integrally attached to respective surfaces of lateral sides of a frame thereof so that said meshed pieces oppose each other across a sweet spot of said badminton racket, wherein each of said meshed pieces is made from titanium, has a predetermined width, is wound around the whole periphery of each of said lateral sides of said frame, and wherein each of said meshed pieces has a weight ranging from 0.2 to 0.5 grams.

3. A tennis racket having meshed pieces integrally attached to respective lateral sides of an oval frame thereof, so that said meshed pieces oppose each other across a sweet spot of the racket, wherein each of said meshed pieces is a meshed strip of titanium having a predetermined width, a laterally central portion which is offset by a predetermined distance, and a weight ranging from 0.7 to 2.0 grams.

4. A badminton racket having meshed pieces integrally attached to respective lateral sides of an oval frame thereof, so that said meshed pieces oppose each other across a sweet spot of the racket, wherein each of said meshed pieces is a meshed strip of titanium having a predetermined width, a laterally central portion that is offset by a predetermined distance, and a weight ranging from 0.2 to 0.5 grams.

5. A racket having meshed pieces integrally attached to the surface of lateral sides of a frame of said racket so that said meshed pieces oppose each other across a sweet spot of said racket, wherein each of said meshed pieces is made of titanium, formed into a predetermined shape, and wound around the whole periphery of said frame.

6. A racket according to claim 5, wherein said frame is of the type used for tennis, and a weight of each of said meshed pieces, attached to said frame, ranges from 0.7 to 2.0 grams.

7. A racket according to claim 5, wherein said frame is of the type used for badminton, and a weight of each of said meshed pieces, attached to said frame, ranges from 0.2 to 0.5 grams.

* * * * *